US005586501A

United States Patent [19]

Burguera et al.

[11] Patent Number: 5,586,501

[45] Date of Patent: Dec. 24, 1996

[54] DISAPPEARING INK MARKING SYSTEM

[76] Inventors: Bartolome Burguera, 1103 8th Ave. South West, Rochester, Minn. 55902; Richard K. Stanzak, P.O. Box 195, Bath, N.C. 27808

[21] Appl. No.: 547,947

[22] Filed: Oct. 25, 1995

[51] Int. Cl.[6] ..... B41M 1/40

[52] U.S. Cl. ..... 104/368; 101/35

[58] Field of Search ..... 101/35, 372, 368, 101/379

[56] References Cited

U.S. PATENT DOCUMENTS

| | | | |
|---|---|---|---|
| 438,179 | 10/1890 | Quarrie | 101/368 |
| 1,528,819 | 3/1925 | Engel | 101/368 |
| 1,655,326 | 1/1928 | Montine | 101/368 |
| 2,754,598 | 7/1956 | Aull | 101/368 |
| 3,438,927 | 4/1969 | Ehrlich | 260/33.4 |
| 3,563,782 | 2/1971 | Liberman et al. | 117/37 |
| 3,617,325 | 11/1971 | Spokes | 117/1.7 |
| 3,949,132 | 4/1976 | Seregely et al. | 428/207 |
| 4,111,462 | 9/1978 | Lange et al. | 282/27.5 |
| 4,162,164 | 7/1979 | Lin | 106/21 |
| 5,018,974 | 5/1991 | Carnahan et al. | 434/98 |

FOREIGN PATENT DOCUMENTS

| | | | |
|---|---|---|---|
| 551180 | 5/1923 | France | 101/368 |
| 243767 | 2/1911 | Germany | 101/368 |

*Primary Examiner*—Edgar S. Burr
*Assistant Examiner*—Anthony H. Nguyen
*Attorney, Agent, or Firm*—Richard L. Miller, P.E.

[57] ABSTRACT

A disappearing ink marking system adaptable to a sole of a user that includes an upper layer, an intermediate layer affixed to the upper layer, a lower layer affixed to the intermediate layer, a reservoir tube passing into the intermediate layer and in fluid communication therewith, disappearing ink, and at least one image block affixed to the lower layer and in fluid communication with the intermediate layer. Disappearing ink flowing through the reservoir tube escapes through the plurality of reservoir tube apertures and enters the intermediate layer and is absorbed therein where upon when pressure is applied to the intermediate layer and the at least one image block the disappearing ink is forced from the intermediate layer through the at least one lower layer aperture and into the at least one image block which in turn causes the at least one image block to disperse the disappearing ink and leave a temporary image.

18 Claims, 1 Drawing Sheet

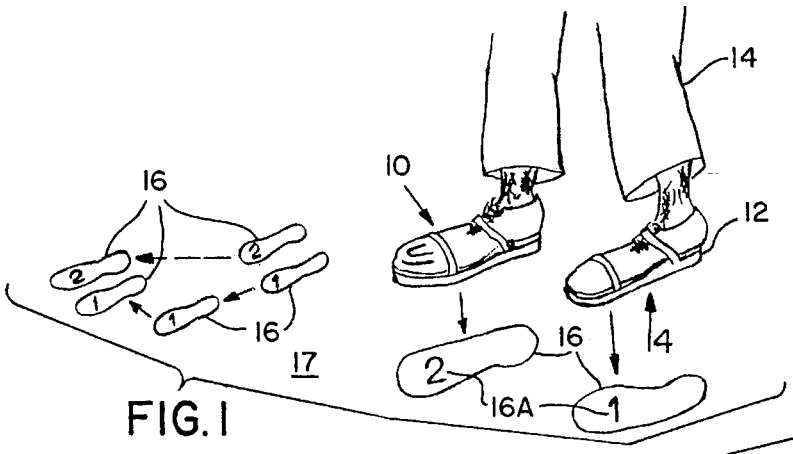
FIG. 1
FIG. 2
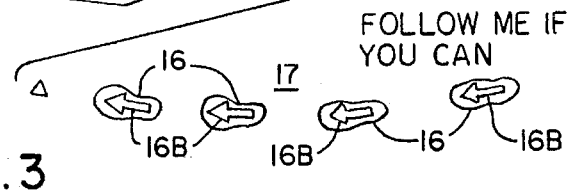
FIG. 6
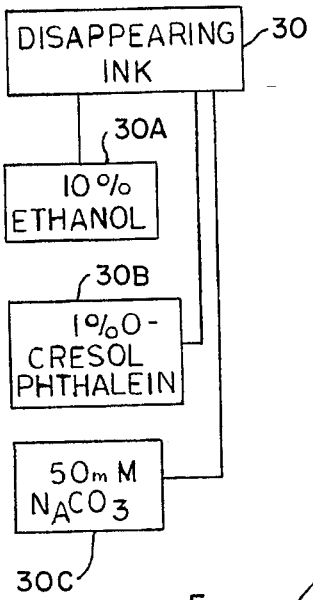
FIG. 3
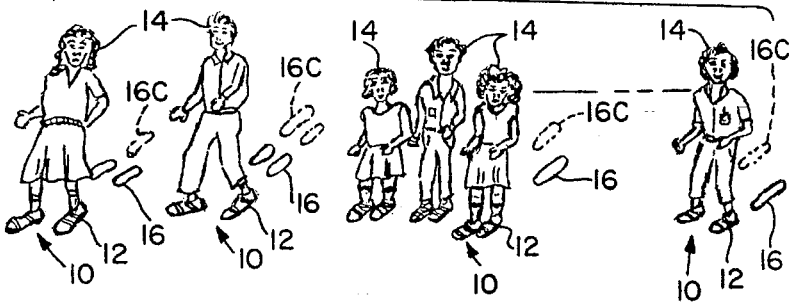
FIG. 4
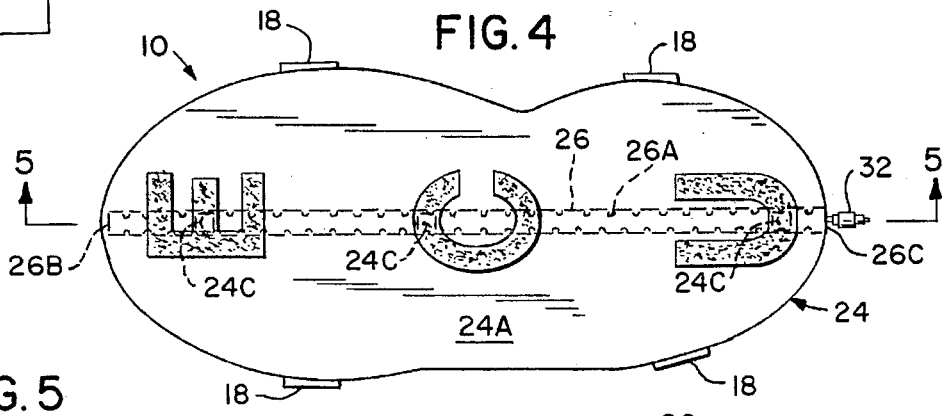
FIG. 5
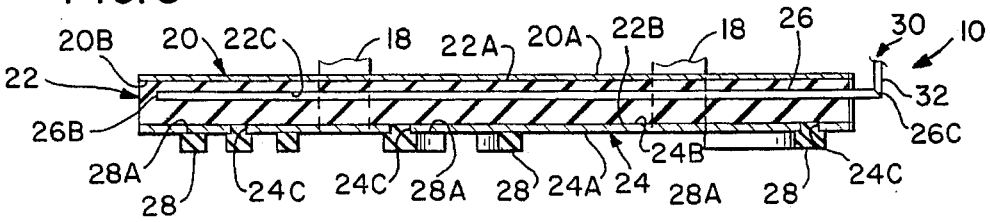

DISAPPEARING INK MARKING SYSTEM

BACKGROUND OF THE INVENTION

The present invention relates to a disappearing ink marking system. More particularly, the present invention relates to a disappearing ink marking system that is adaptable to the sole of a user.

Numerous innovations for marking systems have been provided in the prior art that will be described. However, even though these innovations may be suitable for the specific individual purposes to which they address, they differ from the present invention in that they do not teach a disappearing ink marking system that is adaptable to the sole of a user.

For example, U.S. Pat. No. 3,438,927 to Ehrlich teaches an invisible ink that includes a low weight percentage of polyvinyl pyrolidone resin, a colorless reagent capable of giving a colored reaction product with another reagent, and butyl or amyl alcohol which is a liquid at room temperature. An appropriate reagent is used to react thereby producing a visible image on the printed surface.

Another example, U.S. Pat. No. 3,563,782 to Liberman teaches a pigmented sheet of polyethylene plastic that has a density in the range of about 0.95 to about 0.96. The sheet has a uniform, substantially smooth, non-glossy surface, and contains minute indentations in the surface. The indentations cause the surface to receive and retain an ink marking composed of a plurality of essentially dry dye particles which adhere to the surface of the sheet but which may be readily removed therefrom by light mechanical abrasion.

Still another example, U.S. Pat. No. 3,949,132 to Seregely et al. teaches an erasing system that includes a marking board that has a marking board with a smooth, hard, non-porous surface of plastic, and a porous point pen that has an ink therein which will deposit uniform, legible traces, markings or lines on the plastic surface and which can be removed therefrom with a dry cloth or paper tissue.

Yet another example, U.S. Pat. No. 4,111,462 to Lange et al. teaches a latent sensitizing ink which includes a non-polymeric, oleophilic, organic Arrhenius acid anion vehicle component, a cationic counter-ion, a thinner, and an oil receptive filler, and at least one color-generating component. The ratio of filler to the vehicle component is about 0.5:1 to about 6:1.

Finally, another example, U.S. Pat. No. 5,018,974 to Carnahan et al. teaches a coloring book that releases fragrances during the normal course of coloring an image without scratching or pulling apart the sheets on which the image is placed.

It is apparent that numerous innovations for marking systems have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a disappearing ink marking system that avoids the disadvantages of the prior art.

Another object of the present invention is to provide a disappearing ink marking system that is simple and inexpensive to manufacture.

Still another object of the present invention is to provide a disappearing ink marking system that is simple and easy to use.

Yet another object of the present invention is to provide a disappearing ink marking system that utilizes a disappearing ink in a marker system.

Still yet another object of the present invention is to provide a disappearing ink marking system that allows a user to write on either non-permeable or permeable surface with an ink that will spontaneously disappear after 30–60 seconds.

Yet still another object of the present invention is to provide a disappearing ink marking system that allows a user the flexibility to display either graphics or text on a variety of surfaces in a temporary manner.

Still yet another object of the present invention is to provide a disappearing ink marking system that is safe, non-toxic, non-destructive, and transient in nature.

Yet still another object of the present invention is to provide a disappearing ink marking system that can be used in advertising or commercial art, as a toy or novelty item, or as a means of self expression.

Still yet another object of the present invention is to provide a disappearing ink marking system that eliminates the need for removing graffiti by washing or cleaning.

Yet still another object of the present invention is to provide a disappearing ink marking system that allows a user to write on a variety of surfaces not normally considered safe with a conventional permanent ink system.

Still yet another object of the present invention is to provide a disappearing ink marking system that may be used to display graphics or text on floors or concrete surfaces.

Yet still another object of the present invention is to provide a disappearing ink marking system that is removably mounted to the sole of a user.

Still yet another object of the present invention is to provide a disappearing ink marking system that may be used to teach dancing, sports, or any other activity that requires the proper placement of the feet.

Yet still another object of the present invention is to provide a disappearing ink marking system that permits a user to leave customized disappearing tracks on any hard surface.

Still yet another object of the present invention is to provide a disappearing ink marking system that includes an upper layer, an intermediate layer affixed to the upper layer, a lower layer affixed to the intermediate layer, a reservoir tube passing into the intermediate layer and in fluid communication therewith, disappearing ink, and at least one image block affixed to the lower layer and in fluid communication with the intermediate layer.

Yet still another object of the present invention is to provide a disappearing ink marking system wherein disappearing ink flowing through the reservoir tube escapes through the plurality of reservoir tube apertures and enters the intermediate layer and is absorbed therein where upon when pressure is applied to the intermediate layer and the at least one image block the disappearing ink is forced from the intermediate layer through the at least one lower layer aperture and into the at least one image block which in turn causes the at least one image block to disperse the disappearing ink and leave a temporary image.

Still yet another object of the present invention is to provide a disappearing ink marking system wherein the pressure is applied to the intermediate layer by the action of the user stepping down on a surface.

Yet still another object of the present invention is to provide a disappearing ink marking system wherein the reservoir tube has a reservoir tube fixed end disposed internal to the intermediate layer and a reservoir tube free end disposed external to the intermediate layer.

Still yet another object of the present invention is to provide a disappearing ink marking system that further includes an injection port nozzle affixed to the reservoir tube free end.

Yet still another object of the present invention is to provide a disappearing ink marking system wherein the at least one image block has a form selected from a group consisting of letters, graphics, and text.

Still yet another object of the present invention is to provide a disappearing ink marking system wherein the intermediate layer is affixed to the upper layer lower surface by an adhesive.

Yet still another object of the present invention is to provide a disappearing ink marking system wherein the lower layer upper surface is affixed to the intermediate layer by adhesive.

Still yet another object of the present invention is to provide a disappearing ink marking system wherein the upper layer is substantially shoe sole shaped.

Yet still another object of the present invention is to provide a disappearing ink marking system wherein the upper layer is a non-porous material.

Still yet another object of the present invention is to provide a disappearing ink marking system wherein the intermediate layer is substantially shoe sole shaped.

Yet still another object of the present invention is to provide a disappearing ink marking system wherein the intermediate layer is a porous sponge-like material.

Still yet another object of the present invention is to provide a disappearing ink marking system wherein the at least one image block is a porous sponge-like material finer than the porous sponge-like material of the intermediate layer.

Yet still another object of the present invention is to provide a disappearing ink marking system wherein the lower layer is substantially shoe sole shaped.

Still yet another object of the present invention is to provide a disappearing ink marking system wherein the lower layer is a non-porous material.

Yet still another object of the present invention is to provide a disappearing ink marking system wherein the at least one image block is removably affixed to the lower layer lower surface by a fastener selected from a group consisting of adhesive and hook and loop.

Still yet another object of the present invention is to provide a disappearing ink marking system wherein the disappearing ink is a mixture of 10% Ethanol, a pH indicator, and 50 mM aqueous NaCO3.

Yet still another object of the present invention is to provide a disappearing ink marking system wherein the pH indicator is 1% o-Cresol Phthalein.

Finally, another object of the present invention is to provide a disappearing ink marking system that further includes at least one retaining strap.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the instant invention illustrated being used for teaching the art of dancing;

FIG. 2 is a diagrammatic view of a floor illustrating someone tracking over it with an embodiment of the instant invention;

FIG. 3 is a diagrammatic perspective view illustrating a group of people utilizing the instant invention and demonstrating the temporary disappearing quality of the images created;

FIG. 4 is an enlarged bottom plan view taken in the direction of arrow 4 in FIG. 1 illustrating atypical bottom of a shoe with the instant invention incorporated therewith;

FIG. 5 is a cross sectional view taken on line 5—5 of FIG. 4 with parts broken away; and FIG. 6 is a block diagram showing the composition of the disappearing ink utilized in the instant invention.

LIST OF REFERENCE NUMERALS UTILIZED IN THE DRAWING

10—disappearing ink marking system of the present invention
12—sole
14—user
16—temporary image
16A—step number
16B—arrow
16C—faint image
17—surface
18—easily adaptable retaining straps
20—upper layer
20A—upper layer outer surface
20B—upper layer inner surface
22—intermediate layer
22A—intermediate layer upper surface
22B—intermediate layer lower surface
22C—intermediate layer longitudinally disposed aperture
24—lower layer
24A—lower layer outer surface
24B—lower layer inner surface
24C—at least one lower layer aperture
26—reservoir tube
26A—plurality of reservoir tube apertures
26B—reservoir tube fixed end
26C—reservoir tube free end
28—at least one image block
28A—image block upper surface
30—disappearing ink
30A—10% Ethanol
30B—1% o-Cresol Phthalein
30C—50 mM of aqueous NaCO3
32—injection port nozzle

DETAILED DESCRIPTION OF THE PREFERRED EMBODIMENT

Referring now to the figures in which like numerals indicate like parts, and particularly to FIGS. 1–3, the disappearing ink marking system of the present invention is shown generally at 10, removably adapted to the sole 12 of a user 14, and creating temporary image 16 on a surface 17.

As can be seen in FIG. 1, the disappearing ink system 10 is being used to teach the proper sequence of steps necessary to teach a specific dance. Each time the user 14 steps, the temporary image 16 is created which depicts a step number 16A. By looking at the step number 16A, the user 14 can ascertain if the proper sequence of steps have been applied.

As can be seen in FIG. 2, the disappearing ink system 10 is being used to play follow the leader or for tracking and stalking. Each time the leader (not shown) steps, the temporary image 16 is created which includes an arrow 16B indicating the direction of travel of the leader. By looking at the arrow 16B, a person (not shown) following the leader can ascertain the direction of travel of the leader, or the person being tracked or stalked.

As can be seen in FIG. 3, the temporary image 16 created by the disappearing ink system 10 is beginning to disappear and creating a faint image 16C that will completely disappear after 30 to 60 seconds.

The configuration of the disappearing ink marking system 10 can best be seen in FIGS. 4, 5, and 6, and as such, will be discussed with reference thereto.

The disappearing ink marking system 10 is affixed to the sole 12 of the user 14 by easily adaptable retaining straps 18 which may be elastic or multiple parts of material, such as, leather which are attached to each other by adhesive, hook and loop pile fastener material sold under the trademark VELCRO®, buckles or the like, but is not limited to that.

The disappearing ink marking system 10 further includes an upper layer 20 of a substantially shoe sole shaped non-porous material, an intermediate layer 22 of a substantially shoe sole shaped porous sponge-like wicking material that functions as a fibrous ink reservoir and is affixed to the upper layer 20, a lower layer 24 of a substantially shoe sole shaped non-porous material affixed to the intermediate layer 22, a reservoir tube 26 that functions as an ink channel and is partially disposed within the intermediate layer 22, at least one image block 28 of porous wicking material of a grade finer than that of the porous winking material of the intermediate layer 22 and which is removably mounted to the lower layer 24 such as, by adhesive, VELCRO® or the like, but is not limited to that, disappearing ink 30 flowable through the reservoir tube 26, and an injection port nozzle affixed to the reservoir tube 26 for receiving the disappearing ink 30.

The upper layer 20 has an upper layer outer surface 20A adaptable to the sole 12 of the user 14, and an upper layer inner surface 20B.

The intermediate layer 22 has an intermediate layer upper surface 22A affixed to the upper layer inner surface 20B by an adhesive, an intermediate layer lower surface 22B, and an intermediate layer longitudinally disposed aperture 22C.

The lower layer 24 has a lower layer outer surface 24A, a lower layer inner surface 24B affixed to the intermediate layer lower surface 22B by an adhesive, and at least one lower layer aperture 24C.

The reservoir tube 26 is partially disposed within the intermediate layer longitudinally disposed aperture 22C and contains a plurality of reservoir tube apertures 26A which are in fluid communication with the intermediate layer 22. Further, the reservoir tube 26 has a reservoir tube fixed end 26B that is disposed entirely within the confines of the intermediate layer 22 and a reservoir tube free end 26C that is disposed external to the intermediate layer 22. The reservoir tube free end is in fluid communication with the injection port nozzle.

The at least one image block 28 has an image block upper surface 28A removably affixed to the lower layer lower surface 24A by VELCRO®, but is not limited to that. The at least one image block is in fluid communication with the intermediate layer 22, and can be in the form of letters, graphics, text or the like.

The composition of the disappearing ink 30 can best be seen in FIG. 6, and as such, will be discussed with reference thereto.

The disappearing ink 30 is a mixture of 10% Ethanol 30A, 1% o-Cresol Phthalein 30B, and 50 mM of aqueous NaCO3 30C. The 1% o-Cresol Phthalein 30B is a pH indicator and can, for all intent and purposes, be substituted by other pH indicators. The 50 mM NaCO3 30C also can, for all intent and purposes, be substituted by a wide variety of basic compounds.

In operation, the disappearing ink 30 is injected into the reservoir tube 26 via the injection port nozzle. The disappearing ink 30 passing through the reservoir tube 26 escapes through the plurality of reservoir tube apertures 26A and enters the intermediate layer 22 where it is absorbed.

When pressure is applied to the intermediate layer 22 and the at least one image block 28, by the action of the user 14 stepping down on the surface 17, the disappearing ink 30 is forced passed the at least one lower layer aperture 24C into the at least one image block 28. This in turn causes the at least one image block to leave the temporary image 16C on the surface 17.

It will be understood that each of the elements described above, or two or more together, may also find a useful application in other types of constructions differing from the types described above.

While the invention has been illustrated and described as embodied in a disappearing ink marking system, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disappearing ink marking system adaptable to a sole of a user, comprising:

a) an upper layer having an upper layer outer surface and an upper layer inner surface;

b) an intermediate layer having an intermediate layer upper surface affixed to said upper layer inner surface and an intermediate layer lower surface, said intermediate layer containing an intermediate layer longitudinally disposed aperture;

c) a lower layer having a lower layer outer surface, a lower layer inner surface affixed to said intermediate layer lower surface, said lower layer containing at least one lower layer aperture;

d) a reservoir tube partially disposed within said intermediate layer longitudinally disposed aperture and containing a plurality of reservoir tube apertures which are in fluid communication with said intermediate layer;

e) a disappearing ink flowable through said reservoir tube; and f) at least one image block having an image block upper surface removably affixed to said lower layer lower surface, said at least one image block being in fluid communication with said at least one lower layer aperture so that said disappearing ink flowing through said reservoir tube escapes through said plurality of reservoir tube apertures and enters said intermediate layer and is absorbed therein where upon when pressure is applied to said intermediate layer and said at least one image block said disappearing ink is forced from said intermediate layer through said at least one lower layer aperture and into said at least one image block which in turn causes said at least one image block to disperse said disappearing ink and leave a temporary image.

2. The system as defined in claim 1, wherein said pressure is applied to the intermediate layer by the action of said user stepping down on a surface.

3. The system as defined in claim 1, wherein said reservoir tube has a reservoir tube fixed end disposed internal to said intermediate layer and a reservoir tube free end disposed external to said intermediate layer.

4. The system as defined in claim 3; further comprising an injection port nozzle affixed to said reservoir tube free end.

5. The system as defined in claim 1, wherein said intermediate layer upper surface is affixed to said upper layer lower surface by an adhesive.

6. The system as defined in claim 1, wherein said lower layer upper surface is affixed to said intermediate layer lower surface by adhesive.

7. The system as defined in claim 1, wherein said upper layer is a non-porous material.

8. The system as defined in claim 7, wherein said upper layer is substantially shoe sole shaped.

9. The system as defined in claim 1, wherein said intermediate layer is a porous sponge-like material.

10. The system as defined in claim 9, wherein said intermediate layer is substantially shoe sole shaped.

11. The system as defined in claim 9, wherein said at least one image block is a porous sponge-like material finer than said porous sponge-like material of said intermediate layer.

12. The system as defined in claim 11, wherein said at least one image block has a form selected from a group consisting of letters, graphics, and text.

13. The system as defined in claim 1, wherein said at least one image block is removably affixed to said lower layer lower surface by a fastener selected from a group consisting of adhesive and hook and loop.

14. The system as defined in claim 1, wherein said lower layer is a non-porous material.

15. The system as defined in claim 14, wherein said lower layer is substantially shoe sole shaped.

16. The system as defined in claim 1, wherein said disappearing ink is a mixture of 10% Ethanol, a pH indicator, and 50 mM aqueous NaCO3.

17. The system as defined in claim 16, wherein said pH indicator is 1% o-Cresol Phthalein.

18. The system as defined in claim 1; further comprising at least one retaining strap.

* * * * *